US006488520B1

(12) United States Patent
Hayes et al.

(10) Patent No.: US 6,488,520 B1
(45) Date of Patent: Dec. 3, 2002

(54) ELECTRICAL CONNECTOR ASSEMBLY WITH SHORTING MEMBERS

(75) Inventors: Earl J. Hayes, South Lyon, MI (US); Raymond B. McLauchlan, Clinton Township, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/033,736

(22) Filed: Dec. 27, 2001

(51) Int. Cl.[7] ..... H01R 29/00
(52) U.S. Cl. ..... 439/188; 439/752
(58) Field of Search ..... 439/188, 489, 439/752, 595; 200/51.1, 51.09

(56) References Cited

U.S. PATENT DOCUMENTS

| | | | | |
|---|---|---|---|---|
| 4,850,260 A | | 7/1989 | Walker et al. | 89/34 |
| 4,850,888 A | | 7/1989 | Denlonger et al. | 439/188 |
| 5,145,356 A | * | 9/1992 | Minnis | 439/352 |
| 5,277,606 A | * | 1/1994 | Giroux et al. | 439/188 |
| 5,702,260 A | | 12/1997 | Kato et al. | 439/164 |
| 5,709,403 A | | 1/1998 | Taguchi et al. | 280/735 |
| 6,129,560 A | | 10/2000 | Baur et al. | 439/76.1 |
| 6,186,805 B1 | | 2/2001 | Krishnaswamy et al. | 439/188 |
| 6,191,949 B1 | | 2/2001 | Hansen et al. | 361/735 |

* cited by examiner

*Primary Examiner*—Renee Luebke
*Assistant Examiner*—Ross Gushi
(74) *Attorney, Agent, or Firm*—Harrington & Smith, LLP

(57) ABSTRACT

An electrical connector including a housing; electrical contacts connected to the housing; and electrical shorting members connected to the housing. Each contact includes a male contact area to form a male electrical connector. Each shorting member is adapted to electrically connect at least two of the contacts to each other. Each one of the contacts is connected to at least one other contact of the contacts in the connector by the shorting member. The shorting members are each movable to a position spaced from the contacts. The contacts are aligned in an array of at least two rows with multiple ones of the contacts in each row.

19 Claims, 5 Drawing Sheets

ELECTRICAL CONNECTOR ASSEMBLY WITH SHORTING MEMBERS

BACKGROUND OF THE INVENTION

1. Field of the Invention

The present invention relates to electrical connectors and, more particularly, to an electrical connector assembly having electrical shorting members.

2. Brief Description of Prior Developments

U.S. Pat. No. 6,186,805 discloses a short circuit electrical connector assembly. The assembly has a male electrical connector with shorting members that contact the male electrical contacts until the female electrical connector is mated with the male electrical connector. Electrical connector assemblies which use a short circuit on contacts when two mating electrical connectors are not mated with each other are used in automobile air bag safety systems. The short circuit helps prevent an air bag ignition system from inadvertently igniting when the mating electrical connectors are disconnected from each other.

There has been a significant increase in the use of air bags in automobiles in recent years. In addition, there has been an increase in the number of air bags used in individual vehicles, including side air bags and seatbelt air bags. There is a desire to reduce the number of electrical connectors used in automobile air bag safety systems and to centralize air bag electronics in order to reduce manufacturing costs.

SUMMARY OF THE INVENTION

In accordance with one aspect of the present invention, an electrical connector is provided including a housing; electrical contacts connected to the housing; and electrical shorting members connected to the housing. Each contact includes a male contact area to form a male electrical connector. Each shorting member is adapted to electrically connect at least two of the contacts to each other. Each one of the contacts is connected to at least one other contact of the contacts in the connector by the shorting member. The shorting members are each movable to a position spaced from the contacts. The contacts are aligned in an array of at least two rows with multiple ones of the contacts in each row.

In accordance with another aspect of the present invention, an electrical connector is provided comprising a housing; and electrical contacts connected to the housing. The contacts are aligned in an array comprising two rows of the contacts. The housing comprises at least two rows of spaced electrical shorting member mover projections extending forward at a forward mating side of the housing for insertion into a mating electrical connector. The at least two rows of projections are located in separate planes generally between the two rows of contacts.

In accordance with one method of the present invention, a method for assembling an electrical connector assembly is provided comprising steps of providing a female electrical connector with two rows of female electrical contacts and a housing with two rows of shorting member mover projections at a front end of the housing; providing a male electrical connector with two rows of male electrical contacts and two rows of movable electrical shorting members connecting pairs of the male electrical contacts in each row to each other; and connecting the male and female electrical connectors to each other, wherein the two rows of shorting member mover projections extend into the male electrical connector to move the two rows of shorting members off of electrical contact with their respective rows of the male contacts, and wherein the shorting members in a first one of the rows of shorting members are moved in an opposite direction from the shorting members in a second one of the rows of shorting members.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
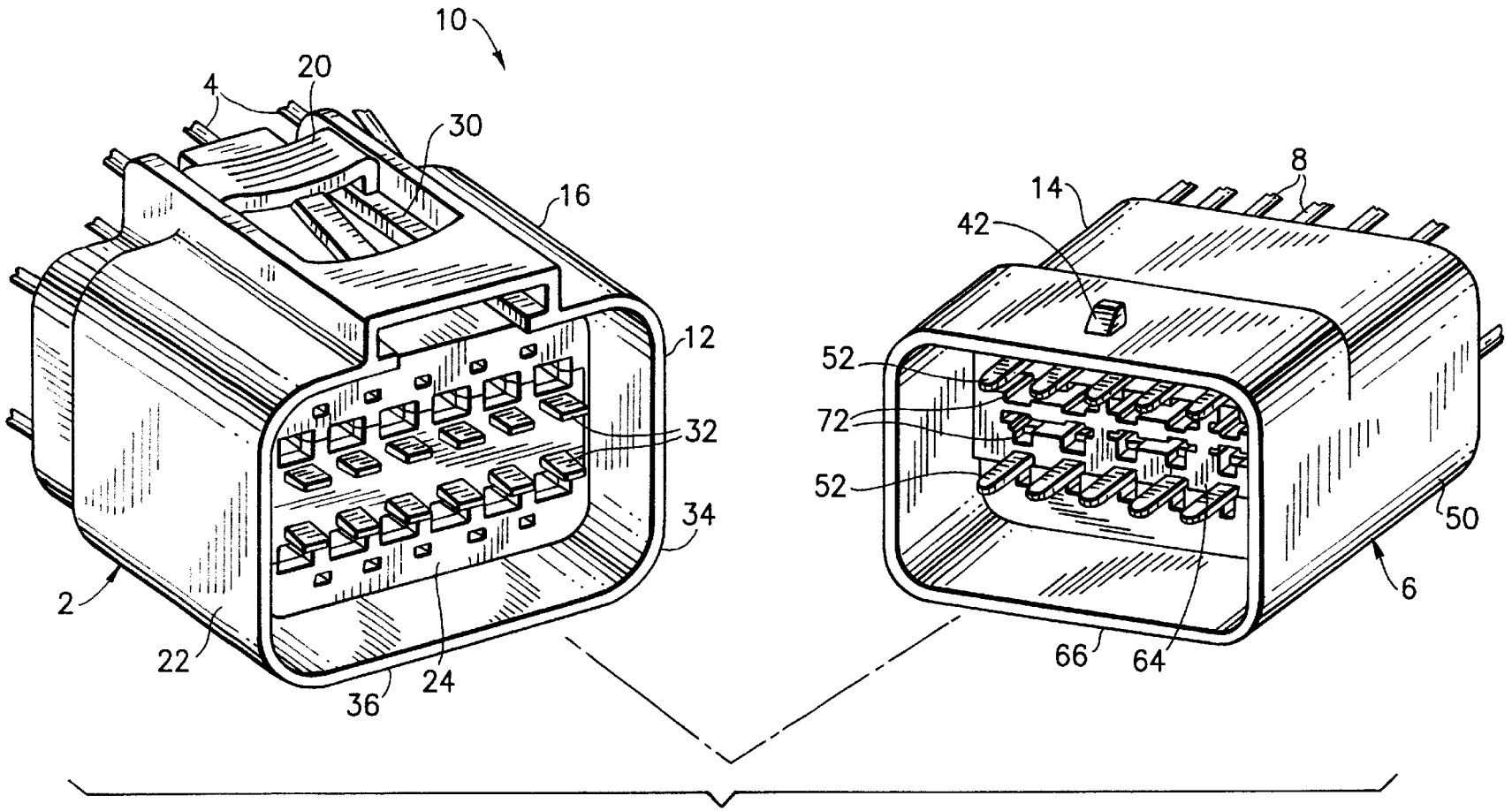
FIG. 1 is a perspective view of two electrical connectors used to form an electrical connector assembly incorporating features of the present invention.

Referring to FIG. 1, there is shown a perspective view of a female electrical connector 12 and a male electrical connector 14 which are used to form an electrical connector assembly 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The female electrical connector 12 is provided as part of an electrical cable assembly 2 which comprises electrical conductors 4, such as wires. However, in alternate embodiments, the female electrical connector 12 could be connected to any suitable type of conductors, such as mounted on a printed circuit board. The male electrical connector 14 is also provided as part of an electrical cable assembly 6 which comprises electrical conductors 8, such as wires. However, in an alternate embodiment, the male electrical connector 14 could be connected to any suitable type of conductors, such as mounted on a printed circuit board.

In the embodiment shown, the electrical connector assembly 10 is provided for an automobile air bag safety system. The connectors 12, 14 are adapted to removably connect airbags in an automobile to a control system for actuating the air bags. However, in alternate embodiments, features of the present invention could be used in any suitable type of electrical connector assembly. Features of the present invention are not necessarily limited to use in an automobile air bag safety system.

Figure 2:
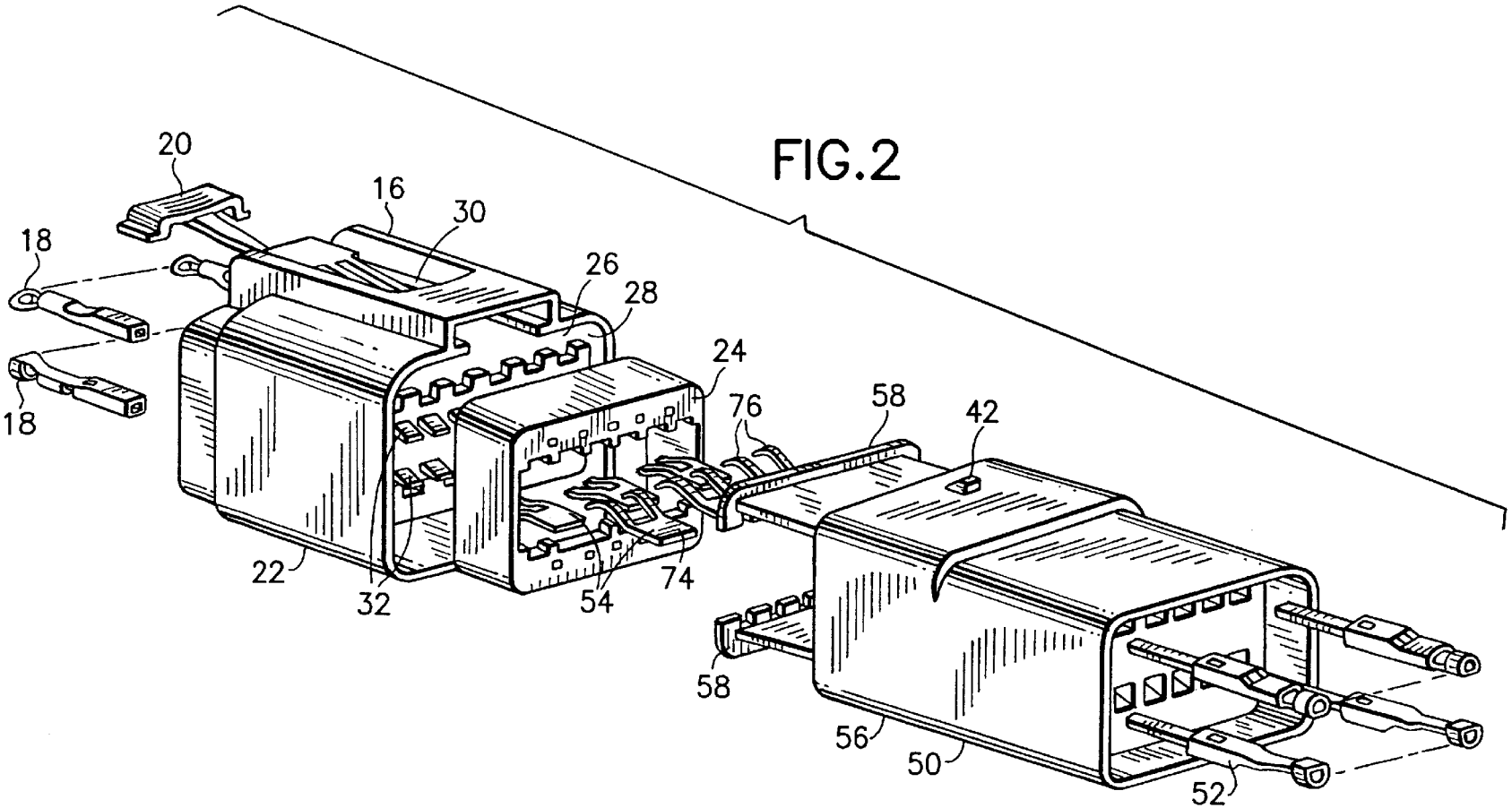
FIG. 2 is an exploded perspective view of the assembly shown in FIG. 1.
Figure 3:
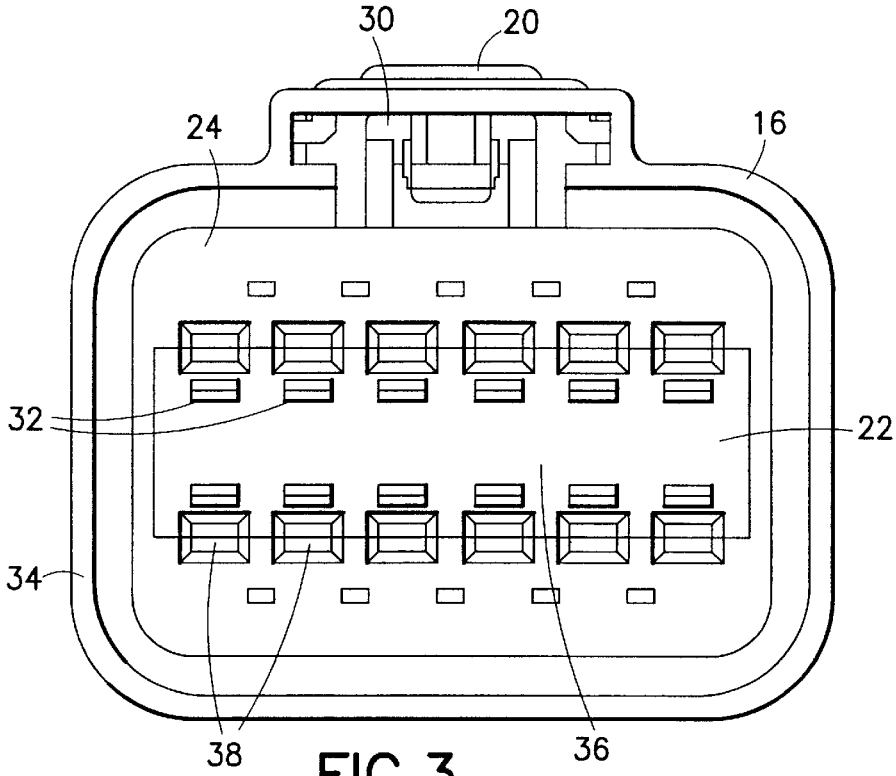
FIG. 3 is a front elevational view of the female electrical connector shown in FIG. 1.
Figure 4:
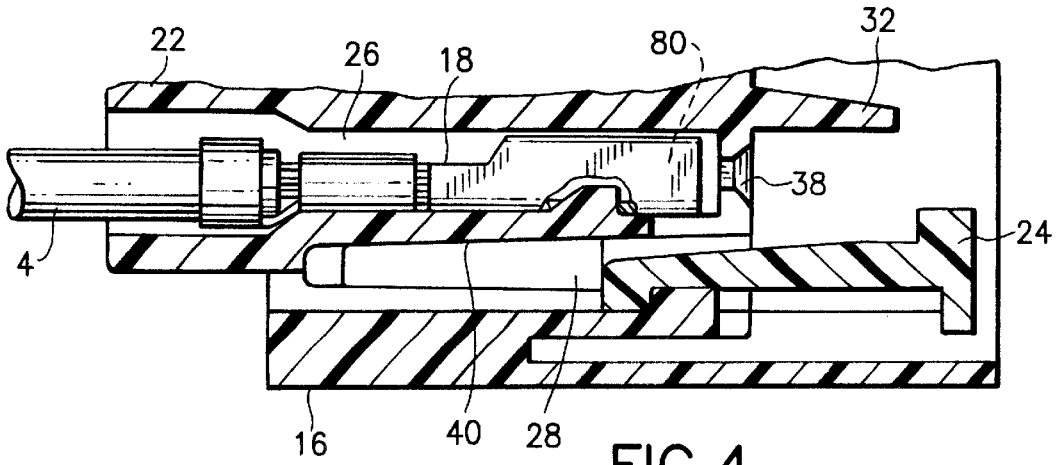
FIG. 4 is a partial cross sectional view of a portion of the female electrical connector shown in FIG. 3 with its secondary lock not fully inserted yet.
Figure 5:
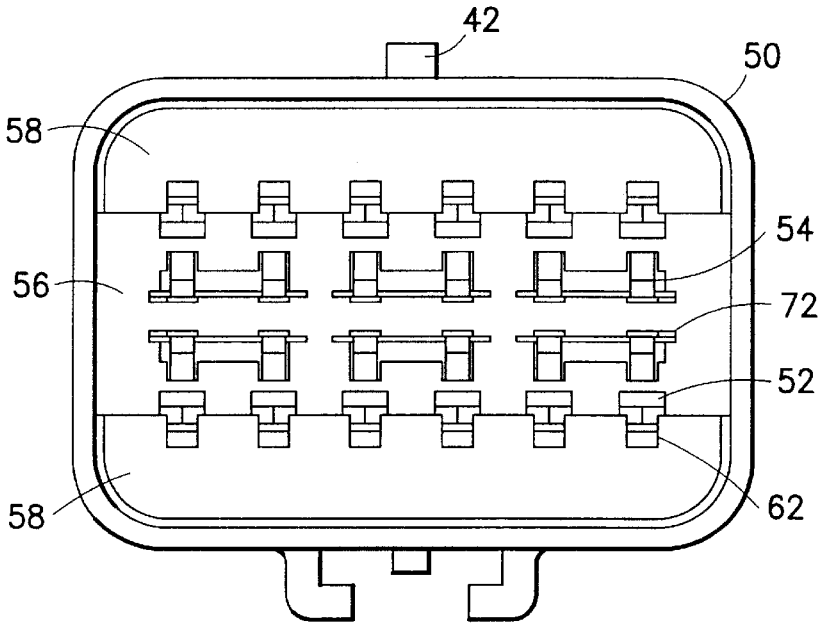
FIG. 5 is a front elevational view of the male electrical connector shown in FIG. 1.

Referring also to FIGS. 2–4, the female electrical connector 12 generally comprises a housing 16, electrical contacts 18, and a connector position assurance (CPA) latch 20. The housing 16, in the embodiment shown, generally comprises a main section 22 and a secondary lock 24. The main section 22 is preferably a one-piece member comprised of molded plastic or polymer material. The secondary lock 24 is also preferably a one-piece member comprised of molded plastic or polymer material. However, in an alternate embodiment, the main section 22 and/or secondary lock 24 could be comprised of multiple members and/or could be comprised of any suitable type of material(s).

The main section 22 generally comprises contact receiving areas 26, secondary lock receiving area 28, latch receiving area 30 and projections 32. A front end 36 of the main section 22 has a forward extending perimeter lip 34. The contact receiving areas 26 extend through the main section 22 between the rear end and the front end of the main section. Apertures 38 at the front end 36 extend into the contact receiving areas 26.

In the embodiment shown, the main section 22 comprises twelve of the contact receiving areas 26. However, in alternate embodiments, the main section 22 could comprise more or less than twelve contact receiving areas. The contact receiving areas 26 are sized and shaped to receive individual ones of the female electrical contacts 18 and fixedly retain the contacts in the contact receiving areas. In the embodiment shown, the contact receiving areas 36 are arranged in an array of two rows having six contact receiving areas in each row. However, in alternate embodiments, any suitable type of array could be provided which comprises multiple rows of contact receiving areas. In addition, each row could comprise any suitable number of contact receiving areas.

The secondary lock receiving area 28 extends into the front end 36 of the main section 22. In the embodiment shown, the secondary lock receiving area 28 has a general ring the shape. However, in alternate embodiments, the secondary lock receiving area could comprise any suitable type of shape. In one type of alternate embodiment, the main section 22 could comprise multiple secondary lock receiving areas. The secondary lock receiving area 28 is sized and shaped to matingly receive the secondary lock 24.

The main section 22 comprises deflectable arms 40 (see FIG. 4) at each of the contact receiving areas 26. The deflectable arms 40 are adapted to resiliently deflect outward when the contacts 18 are inserted, and latch back inward to latch the contacts inside the main section 22. When the secondary lock 24 is fully inserted into the secondary lock receiving area 28, the secondary lock 24 prevents the deflectable arms 40 from deflecting outward. Thus, because the deflectable arms are prevented from deflecting outward by the secondary lock 24, this allows the deflectable arms 40 to fixedly retain the contacts 18 in the contact receiving areas 26. In alternate embodiments, any suitable type of latching system for latching the contacts 18 in the housing 16 could be provided. In an alternate embodiment, the secondary lock might not be provided.

The latch receiving area 30 is located on a top side of the main section 22. The latch receiving area 30 is sized and shaped to receive the CPA latch 20. The CPA latch 20 can be movably located in the latch receiving area 30. The CPA latch 20 is adapted to latch onto the latch 42 on the male electrical connector 14. The CPA latch 20 is generally well known in the art.

The projections 32 extend in a forward direction at the front end 36 of the main section 22. The projections 32 have a general cantilevered wedge shape. However, in alternate embodiments, the projections could have any suitable type of shape. In the embodiment shown, the main section 22 comprises twelve of the projections 32. However, in alternate embodiments, more or less than twelve projections could be provided. The twelve projections 32 are aligned in an array of two rows. In an alternate embodiment, the projections 32 in each row could be replaced by a single elongate projection.

Each row comprises six of the projections 32. However, in alternate embodiments, any suitable type of array could be provided which comprises multiple rows of projections. In addition, each row could comprise any suitable number of projections. In the embodiment shown, the two rows of projections 32 are located in planes between the two rows of contact receiving areas 26. In an alternate embodiment, the rows of projections 32 could be located in planes outside the two rows of contact receiving areas 26. In another alternate embodiment, one of the rows of projections 32 could be located in a plane between the two rows of contact receiving areas and another one of the rows of projections could be located in a plane outside the two rows of contact receiving areas.

Referring now to FIGS. 1, 2, 5 and 6, the male electrical connector 14 generally comprises a housing 50, electrical contacts 52, and the electrical shorting members 54. However, in alternate embodiments, the male electrical connector could comprise alternative or additional components. The housing 50 generally comprises a main section 56 and two secondary locks 58.

Figure 6:
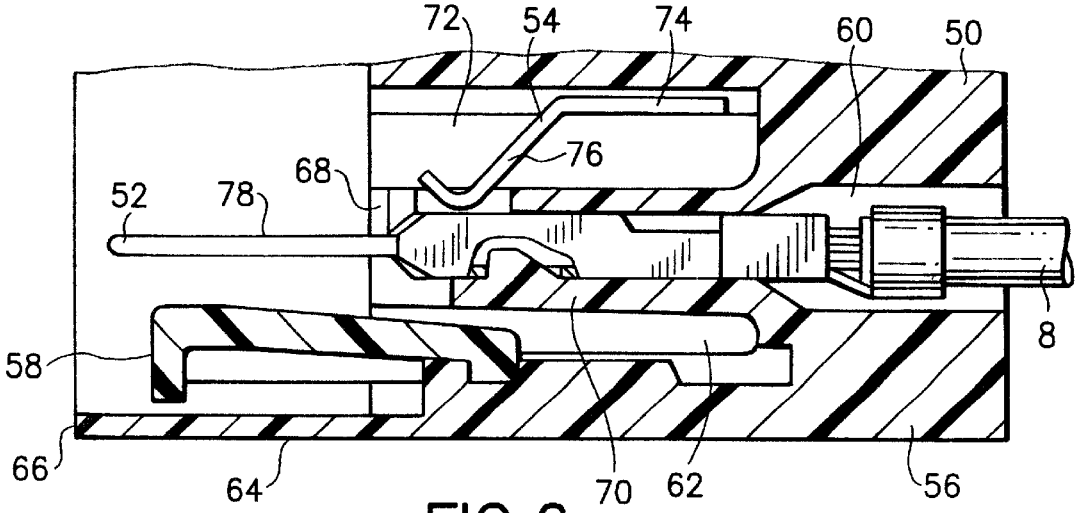
FIG. 6 is a partial cross sectional view of a portion of the male electrical connector shown in FIG. 5 with its secondary locks not fully inserted yet.
Figure 7:
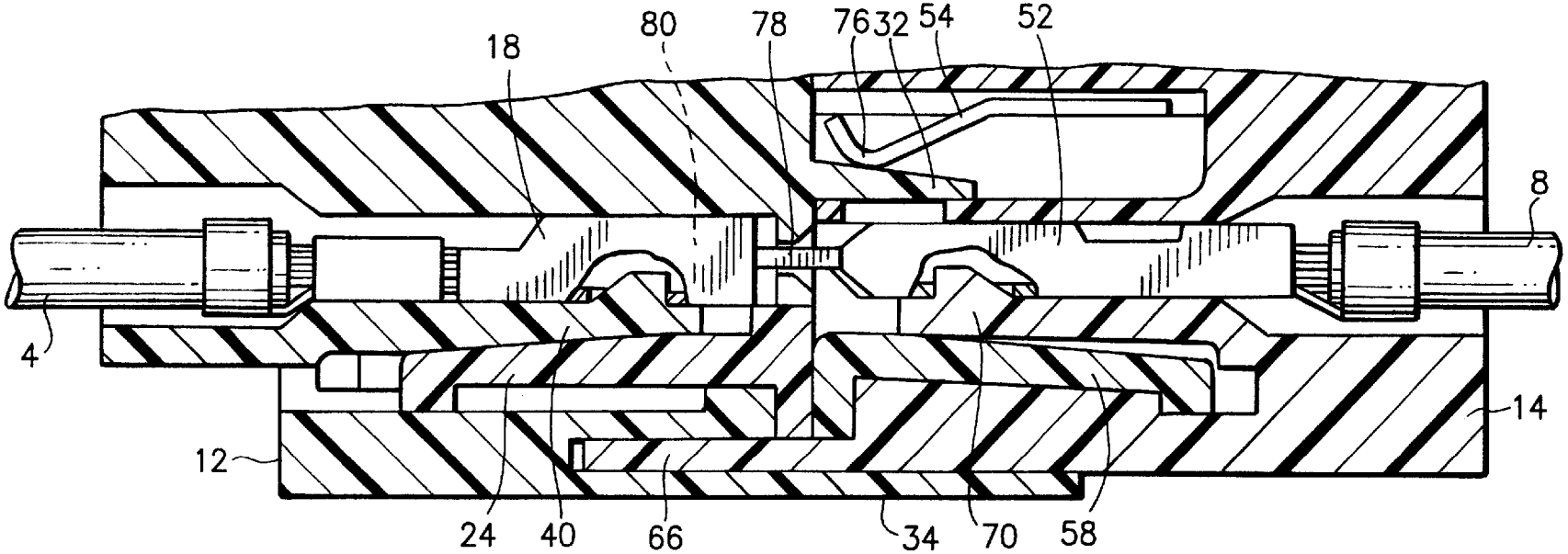
FIG. 7 is a partial cross sectional view of the portions of the male and female electrical connectors shown in FIGS. 4 and 6 in an assembled position.

The main section 56 is preferably a one-piece member comprised of molded plastic or polymer material. FIG. 6 shows one of the two secondary locks 58 in a position not fully inserted into its locking position. FIG. 7 shows the secondary lock 58 in its fully inserted locking position in the main section 56. The secondary locks 58 are also preferably one-piece members comprised of molded plastic or polymer materials. However, in alternate embodiments, the main section 56 could be comprised of multiple members, the secondary locks 58 could be comprised of a single member, and/or the main section 56 and secondary locks 58 could be comprised of any suitable type of material(s).

The main section 56 generally comprises contact receiving areas 60 and secondary lock receiving areas 62. The front end 64 of the main section 56 has a forward extending perimeter lip 66. The perimeter lip 66 is sized and shaped to extend into the area inside the perimeter lip 34 of the female electrical connector 12.

The contact receiving areas 60 extend through the main section 56 between the front end and the rear end of the main section. Apertures 68 at the front end 64 extend into the contact receiving areas 60.

In the embodiment shown, the main section 56 comprises twelve of the contact receiving areas 60. However, in alternate embodiments, the main section 56 could comprise more or less than twelve contact receiving areas. The contact receiving areas 60 are aligned in an array to allow the male electrical contacts 52 to matingly connect with the female electrical contacts 18 of the female electrical connector. The contact receiving areas 60 are sized and shaped to receive individual ones of the male electrical contacts 52 and fixedly retain the contacts in the contact receiving areas. The contact receiving areas 60 are arranged in an array of two rows having six contact receiving areas in each row. However, in alternate embodiments, any suitable type of array could be provided which comprises multiple rows of contact receiving areas. In addition, each row could comprise any suitable number of contact receiving areas.

The secondary lock receiving areas 62 extend into the front end 64 of the main section 56. In the embodiment shown, the secondary lock receiving areas 58 have general slot shapes and are located on opposite sides of two rows of contact receiving areas 60. However, in alternate embodiments, the secondary lock receiving areas could comprise any suitable type of shape. The secondary lock receiving areas 62 are sized and shaped to matingly receive the secondary locks 58.

The main section 56 of the housing 50 comprises deflectable arms 70 at each of the contact receiving areas 60. The deflectable arms 70 are adapted to resiliently deflect outward when the contacts 52 are inserted, and latch back inward to latch the contacts inside the main section 56. When the secondary locks 58 are fully inserted into the secondary lock receiving areas 62, the secondary locks 58 prevent the deflectable arms 70 from deflecting outward. Thus, because the deflectable arms are prevented from deflecting outward by the secondary locks 58, this allows the deflectable arms 70 to fixedly retain the contacts 52 in the contact receiving areas 60. In alternate embodiments, any suitable type of latching system for latching the contacts 52 in the housing 50 could be provided. In an alternate embodiment, the secondary locks might not be provided.

The main section 56 of the housing 50 also comprises shorting member receiving areas 72. The shorting member receiving areas 72 are sized and shaped to receive the electrical shorting members 54 therein. The shorting member receiving areas 72 extend into the front end 64 of the main section 56. The shorting member receiving areas 72 are arranged in an array of two rows located between the two rows of contact receiving areas 60. However, in alternate embodiments, the shorting member receiving areas 72 could be located in any suitable type of array, and/or could be located outside the two rows of contact receiving areas, or one inside and one outside. Each shorting member receiving area is provided for a single pair of the contact receiving areas 60. However, in alternate embodiments, one shorting member receiving area could be provided for more than two contact receiving areas.

The electrical shorting members or bars 54 are comprised of electrically conductive material, such as metal. In a preferred embodiment, the electrical shorting members 54 are comprised of stamped and formed sheet metal. Each electrical shorting member 54 generally comprises a mounting section 74 and two contact arms 76. In alternate embodiments, the electrical shorting member 54 could comprise more or less than two contact arms. In other alternate embodiments, any suitable type or shape of electrical shorting member(s) could be provided.

In the embodiment shown, the connector comprises six of the electrical shorting members 54. However, in alternate embodiments, more or less than six shorting members could be provided. The electrical shorting members 54 in a first one of the rows of members 54 are orientated in an revered orientation to the electrical shorting members in the other row of members 54. However, in an alternate embodiment, they could be orientated in a same orientation. The mounting section 74 is adapted to mount the shorting member 54 to the main section 56 in the receiving area 72. The contact arms 76 extend into the contact receiving areas 60 proximate the front apertures 68. The contact arms 76 make electrical contact with respective ones of a pair of the electrical contacts 52. However, the contact arms 76 are resiliently deflectable in inward directions away from contact with the electrical contacts 52.

The male electrical connector 14 comprises twelve of the male electrical contacts 52. However, in alternate embodiments, the male electrical connector could comprise any number of male electrical contacts. The male electrical contacts could also comprises different shapes. Each male electrical contact 52 comprises a male contact section 78. The male contact sections 78 extend in a forward direction out of the apertures 68. The male contact sections 78 are sized and shaped to be removably inserted into the receiving areas 80 of the female electrical contacts 18. The male electrical contacts 52 and the female electrical contacts 18 could comprise any suitable type of contacts, such as APEX terminal system electrical contacts manufactured and sold by FCI USA, Inc.

Referring now also to FIG. 7, portions of the female and male electrical connectors 12, 14 are shown in a mated configuration. When the two connectors 12, 14 are mated to each other, the male contact sections 78 of the male electrical contacts 52 extend into the receiving areas 80 of the female electrical contacts 18. This electrically connects the conductors 4, 8 to each other. The projections 32 extend into the apertures 68. The projections 32 extend between the contact arms 76 and the male electrical contacts 52. As the projections 32 are inserted, the contact arms 76 are deflected away from the male electrical contacts 52. Thus, the electrical short circuit of a pair of the male electrical contacts 52 by the electrical shorting members 54 is stopped. Because the two rows of contact arms 76 are moved in opposite directions by the projections 32, the forces encountered by deflection of the contact arms 76 are cancelled out or equalized by each other for easier insertion.

The embodiment described above can utilize a terminal system in a twelve-way (2×6) connector system. The connector system can comprise six shorting members to create an in-line connector capable of handling six different airbags circuits. With the proliferation of air bags in automobiles, automobile manufacturers are starting to envision centralization of air bag electronics. Centralization of air bag electronics could provide reduced costs and enable the electronics to be placed in a more protective area. The connector concept of the present invention can address the issue of combining the individual airbags circuits into one connector, thus reducing cost and space requirements. The concept can combine six or more air bag connections into a single multi-row connector system (such as 6×2). To date, there has been no indications that any attempt has been made in the prior art to develop and manufacture a multiple row air bag connector.

The present invention can provide a shunting capability in a multi-row connector that minimizes the overall size of the connector. The present invention can provide for use of existing electrical contacts, such as APEX terminals. The present invention also allows the ability to shunt all pairs of the terminals (six or more pairs) with one connection operation.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing;

electrical contacts connected to the housing, each contact comprising a male contact area to form a male electrical connector; and electrical shorting members connected to the housing, each shorting member being adapted to electrically connect at least two of the contacts to each other, wherein each one of the contacts is connected to at least one other contact of the contacts in the connector, wherein the shorting members are each movable to a position spaced from the contacts, and wherein the contacts are aligned in an array of at least two rows with multiple ones of the contacts in each row.

2. An electrical connector as in claim 1 wherein the housing comprises a main section and at least two secondary lock members located in receiving areas of the main section.

3. An electrical connector as in claim 2 wherein the secondary lock members are located between the electrical contacts and outer sides of the main section.

4. An electrical connector as in claim 1 wherein each electrical shorting member comprises two spring arms, each spring arm contacting a respective one of the electrical contacts.

5. An electrical connector as in claim 1 wherein the electrical shorting members are located between the two rows of electrical contacts.

6. An electrical connector as in claim 5 wherein the electrical shorting members are aligned in rows parallel to the rows of electrical contacts.

7. An electrical connector as in claim 6 wherein the electrical shorting members in a first one of the rows of electrical shorting members and the electrical shorting members in a second one of the rows of electrical shorting members are deflectable towards each other away from their respective electrical contacts.

8. An electrical connector as in claim 6 wherein the electrical shorting members in a first one of the rows of electrical shorting members and the electrical shorting members in a second one of the rows of electrical shorting members are deflectable away from their respective electrical contacts in reverse directions.

9. An electrical connector as in claim 1 wherein each row of electrical contacts comprises six of the electrical contacts, and wherein the electrical connector comprises six of the electrical shorting members located in two rows between the two rows of electrical contacts.

10. An electrical connector assembly comprising:

a male electrical connector as in claim 1; and a female electrical connector connected to the male electrical connector, the female electrical connector comprising:

a female connector housing; and female electrical contacts connected to the female connector housing, the female contacts being aligned in an array comprising two rows of the female contacts, wherein the female connector housing comprises at least two rows of spaced electrical shorting member mover projections extending forward at a forward mating side of the female connector housing inserted into the male electrical connector, and wherein the at least two rows of projections are located in separate planes generally between the two rows of female contacts.

11. An electrical connector comprising:

a housing; and electrical contacts connected to the housing, the contacts being aligned in an array comprising two rows of the contacts, wherein the housing comprises at least two rows of spaced electrical shorting member mover projections extending forward at a forward mating side of the housing for insertion into a mating electrical connector, and wherein the at least two rows of projections are located in separate planes generally between the two rows of contacts.

12. An electrical connector as in claim 11 wherein the housing comprises a main section and a secondary lock connected to the main section, the secondary lock comprising a ring shaped member extending into a front side of the main section.

13. An electrical connector as in claim 11 wherein each row of projections comprises at least six of the projections.

14. An electrical connector as in claim 11 wherein each projection is aligned with one of the electrical contacts.

15. An electrical connector as in claim 11 wherein each projection comprises a cantilevered wedge shaped shelf.

16. An electrical connector assembly comprising:

a female electrical connector comprising the electrical connector as in claim 11;

a mating male electrical connector comprising:

a male connector housing;

male electrical contacts connected to the male connector housing, each male contact comprising a male contact area to form a male electrical connector; and electrical shorting members connected to the male connector housing, each shorting member being adapted to electrically connect at least two of the male contacts to each other, wherein the shorting members are moved to a position spaced from the male contacts by the projections of the female electrical connector, and wherein the male contacts are aligned in an array of at least two rows with multiple ones of the male contacts in each row.

17. An electrical connector assembly as in claim 16 wherein the electrical shorting members are arranged in two rows, the two rows of electrical shorting members being deflected in opposite respective directions by the projections of the female electrical connector.

18. A method for assembling an electrical connector assembly comprising steps of:

providing a female electrical connector with two rows of female electrical contacts and a housing with two rows of shorting member mover projections at a front end of the housing;

providing a male electrical connector with two rows of male electrical contacts and two rows of movable electrical shorting members connecting pairs of the male electrical contacts in each row to each other; and connecting the male and female electrical connectors to each other, wherein the two rows of shorting member mover projections extend into the male electrical connector to move the two rows of shorting members off of electrical contact with their respective rows of the male contacts, and wherein the shorting members in a first one of the rows of shorting members are moved in an opposite direction from the shorting members in a second one of the rows of shorting members.

19. A method as in claim 18 wherein the two rows of shorting members are moved towards each other in inward directions.

* * * * *